United States Patent [19]

Audeh

[11] Patent Number: 4,985,389

[45] Date of Patent: Jan. 15, 1991

[54] POLYSULFIDE TREATED MOLECULAR SIEVES AND USE THEREOF TO REMOVE MERCURY FROM LIQUEFIED HYDROCARBONS

[75] Inventor: Costandi A. Audeh, Princeton, N.J.

[73] Assignee: Mobil Oil Corporation, Fairfax, Va.

[21] Appl. No.: 428,819

[22] Filed: Oct. 30, 1989

Related U.S. Application Data

[62] Division of Ser. No. 102,958, Sep. 30, 1987, Pat. No. 4,877,515.

[51] Int. Cl.[5] ..... B01J 27/02

[52] U.S. Cl. ..... 502/516; 502/216; 502/220; 502/222; 502/223; 502/407; 502/411; 502/500; 208/251 R

[58] Field of Search ..... 502/516, 407, 216, 411, 502/219, 220, 222, 223; 208/251 R

[56] References Cited

U.S. PATENT DOCUMENTS

| | | | |
|---|---|---|---|
| 3,516,947 | 6/1970 | Dudzik | 208/109 |
| 4,474,896 | 10/1984 | Chao | 502/219 X |
| 4,877,515 | 10/1989 | Audeh | 208/251 R |

*Primary Examiner*—Helane E. Myers

*Attorney, Agent, or Firm*—Alexander J. McKillop; Charles J. Speciale

[57] ABSTRACT

Disclosed herein is a process for removing contaminating mercury from hydrocarbon streams, gas or liquid, wherein the stream is contacted with a molecular sieve pretreated with an alkali polysulfide. The pretreatment consists of saturating the sieve with an aqueous solution of the polysulfide and subsequently drying the saturated sieve under conditions calculated to dry but not decompose the polysulfide present.

11 Claims, No Drawings

POLYSULFIDE TREATED MOLECULAR SIEVES AND USE THEREOF TO REMOVE MERCURY FROM LIQUEFIED HYDROCARBONS

This is a division of copending application Ser. No. 102,958, filed on Sept. 30, 1987 now U.S. Pat. No. 9,877,515.

NATURE OF THE INVENTION

This invention relates to a method for purifying and removing trace amounts of mercury from hydrocarbons, particularly liquid hydrocarbons. In another aspect this invention comprises a method for treating molecular sieves with an alkali polysulfide to enhance removal of mercury and further comprises the resulting sulfided molecular sieve product which is impregnated with an alkali polysulfide.

PRIOR ART

Trace quantities of mercury are known to exist in natural gases but the significance of these trace quantities has not been recognized until recently. The mercury detected in the produced gas is now known not to result from well drilling or well completion operations and does not result by accident in the gas stream. The mercury is produced in association with the gas and is thought to originate from geologic deposits in which the natural gas occurs. Even in trace quantities however, mercury is an undesirable component of natural gas. The processing of natural gas in LNG plants requires contact between the natural gas and equipment made primarily of aluminum. This is particularly true after the steps of treating the gas to remove carbon dioxide and hydrogen sulfide, when the gas is chilled or cooled in aluminum-constructed heat exchangers. Aluminum heat exchangers represent a capital investment of several million dollars. Damage to these exchangers is to be avoided if at all possible. Although the concentration of mercury in natural gas appears low, the effect of mercury is cumulative as it amalgamates with the aluminum. The result is damage to the system such as corrosion cracking which can lead to equipment failure. Repair is correspondingly difficult because of damage to the welded seams of the aluminum. Replacement of the heat exchangers in an LNG plant represents a large expenditure. The problem of mercury in natural gas is discussed further in U.S. Pat. No. 4,094,777 and French Patent No. 2,310,795, both of which are incorporated herein by reference.

Several methods have been proposed for absorbing mercury from natural gas. For example, J. E. Leeper in Hydrocarbon Processing, Volume 59, Nov., 1980, pages 237–240, describes a procedure in which natural gas is contacted with a fixed bed of copper sulfide on an alumina-silica support to remove the mercury present. Another commercial process is based on contacting the mercury contaminated gas with sulfur supported on activated carbon. According to the Leeper article, the sulfur impregnated activated charcoal process is regarded as the best system for treating a gas stream, particularly one free of heavy hydrocarbons. The reference, Hydrocarbon Processing, Volume 59, Nov., 1980, pages 237–240, is incorporated herein by reference.

U.S. Pat. No. 4,474,896 discloses the use of water insoluble polysulfide-containing adsorbent compositions and their use in the removal of elemental mercury from gaseous and liquid streams.

A primary object of this invention is to provide an improved process for removing trace quantities of mercury present in hydrocarbon liquids and gases. Still another object of this invention is to provide a process for preparing a suitable absorbent and the resulting sorbent composition.

SUMMARY OF THE INVENTION

Briefly stated, this invention comprises in one aspect contacting a gas or liquid hydrocarbon stream contaminated with mercury with a polysulfide-containing molecular sieve treated as hereinafter described. In another aspect this invention comprises a method for treating a molecular sieve to render it adsorbent to mercury comprising contacting the molecular sieve with an aqueous solution of an alkali polysulfide, such as sodium polysulfide, and drying the treated molecular sieve under conditions wherein most of the moisture present will be removed, but the polysulfide will not be decomposed. The process is particularly useful in treating any dry gas stream or liquid hydrocarbon stream.

In another aspect this invention comprises the treated molecular sieve product resulting from the afore summarized process.

DESCRIPTION OF THE INVENTION

The molecular sieve composition is prepared for use in the mercury adsorption process by first calcining the sieve at a temperature sufficient to remove moisture from the molecular sieve, preferably a temperature between about 350° and about 450° C. The drying (calcining) is accomplished in an atmosphere of inert gas such as anhydrous argon. The dried molecular sieve material is then cooled to ambient temperature while remaining in the same inert atmosphere. The molecular sieve used can be any zeolite capable of absorbing water and preferably is in the acid form or alkali metal or alkaline earth metal exchanged form. The molecular sieve can be one selected from the group consisting of sodium zeolite X, zeolite Y, other synthetic faujasites, zeolite beta and zeolite 20, of these sodium zeolite X being preferred.

The aqueous solution of sodium polysulfide is easily prepared from $Na_2S.9H_2O$ and elemental sulfur by heating a solution of $Na_2S.9H_2O$ in water with the desired amount of sulfur to provide a solution containing $Na_2S_X$. Typically such aqueous solutions contain 5 to 25% sulfur. When the solution is used to impregnate a solid support, without exchange of cationic species it reacts with elemental mercury as shown in the examples to follow. The use of a solid support for such reactive aqueous solutions allow for their use at temperature below the freezing point of the aqueous solutions and permits their use at temperatures which may be encountered during the liquefaction of hydrocarbon gases, such as n-butane or iso-butane. It is preferred that the aqueous solution contain between 20 and 25% sulfur. This aqueous solution is then added to the calcined molecular sieve in sufficient quantity so that the sieve material is completely saturated with the aqueous solution of sodium polysulfide. The saturated molecular sieve material is dried preferably in two stages under reduced pressure. In the first stage the moisture is removed at a pressure of about 1 millimeter of mercury at ambient (room) temperature. In the second stage the product is further dried maintaining the pressure at about 1 millimeter and raising the temperature stepwise, such as 10 degrees per hour, to a temperature of 50° C.

It is essential in this heating step not to exceed the temperature at which the alkali polysulfide was prepared. The treated molecular sieve product is now ready for use in the process of this invention.

The removal of mercury from a hydrocarbon liquid or gaseous stream is effected by flowing the stream of gas or liquid through a bed containing the prepared molecular sieve absorbent material. In the case of a liquid, this can be done effectively by introducing the liquid into the top of a tower or column and allowing the liquid to permeate down through a bed packed with the molecular sieve material. The treated hydrocarbon stream is then removed for further treating, storage, or sales.

EXAMPLES

One hundred (100) grams of molecular sieves sodium-exchanged zeolite X, in the form of 1/16-inch extrudate were calcined at 350° C. in a flowing stream of anhydrous argon for 16 hours and subsequently cooled to room temperature in the same stream of flowing argon. One-hundred and fifty (150) grams of an aqueous solution of sodium polysulfide containing 22% sulfur were then added carefully to the calcined sieves, in small amounts and with constant mixing, until the solid became fully saturated with the aqueous sodium polysulfide solution. This amount of sodium polysulfide solution was sufficient to saturate the calcined sieves without the formation of a slurry. The saturated molecular sieves were then dried in two stages in a vacuum oven. In the first stage, the moisture was removed at a pressure of about 1 mm at room temperature. In the second stage, the temperature of the vacuum oven in which the pressure was kept at about 1 mm pressure, was raised carefully at a rate of about 10° C./hour until the temperature reached 50° C. so as to ensure that the temperature at which the polysulfide was prepared was not exceeded.

For comparison purposes 100 grams of the same kind of molecular sieves were wetted with water in the absence of any added treating agent and then subjected to the same drying procedures described immediately above.

EXAMPLE 1

The molecular sieves not treated with sodium polysulfide were then tested for their ability to absorb mercury. Ten (10) grams of treated sieves were contacted with 50 cc of pentane containing 10 ppb of mercury at room temperature. The treated pentane contained 10 ppb of mercury. This demonstrates that molecular sieves treated only with water as described above, have no ability to remove mercury from a hydrocarbon stream.

EXAMPLE 2

Four (4) Grams of the treated solium zeolite X were placed in a reactor and cooled to −20° C. The cooled treated solid was then allowed to contact a stream of pentane containing 10 ppb mercury, also cooled to −20° C., at a weight hourly space velocity of 1, i.e., 1 gram of pentane for every gram of catalyst for every hour (1 W $h^{-1}$). The effluent pentane contained 0.9 ppb of mercury.

EXAMPLE 3

Example 2 was repeated at a temperature of 0° C. The effluent treated pentane contained 0.2 ppb of mercury.

EXAMPLE 4

Example 2 was repeated at a temperature of +20° C. and a WHSV of 4. The effluent treated pentane had a mercury content of 0.4 ppb.

EXAMPLE 5

Example 4 was repeated at a temperature of 95° C. The effluent treated pentane had a mercury content of 0.5 ppb.

Examples 2 to 5 demonstrated that sodium zeolite X impregnated with sodium polysulfide has the ability to remove mercury from a hydrocarbon stream.

What is claimed is:

1. A process for preparing a molecular sieve absorbent comprising:

(a) drying a molecular sieve at a temperature of between about 350° and about 450° C. in an anhydrous nonreactive atmosphere;

(b) contacting said molecular sieve with an aqueous solution of water soluble alkali polysulfide until said molecular sieve is saturated with said aqueous solution; and (c) drying said saturated molecular sieve of (b) at a temperature between about 10° and about 75° C. and a pressure of less than about 500 millimeters of mercury to deposit said water soluble alkali polysulfide onto said molecular sieve without decomposing the water soluble alkali polysulfide.

2. The process of claim 1 wherein the molecular sieve is selected from the group consisting of sodium zeolite X, sodium zeolite Y, zeolite beta and zeolite 20.

3. The process of claim 1 wherein the molecular sieve is a synthetic faujasite.

4. The process of claim 1 wherein the molecular sieve is sodium zeolite X.

5. The process of claim 1 wherein said alkali sulfide is sodium polysulfide containing between about 5 and about 25% sulfur.

6. The process of claim 1 wherein said saturated product of (b) is dried in a two step process wherein the first step comprises drying the molecular sieve at a temperature between about 10° and about 30° C. and a reduced pressure and subsequently drying the resulting product at a temperature between about 30° and about 75° C. under a pressure of about 1 millimeter of mercury.

7. The process of claim 1 wherein the concentration of sulfur in the alkali polysulfide is between about 5 and about 25% by weight.

8. An absorbent suitable for removing mercury from a gaseous liquid hydrocarbon stream or gaseous stream comprising the product produced by:

(a) drying a molecular sieve at a temperature of between about 350° and about 450° C. in anhydrous nonreactive atomsphere;

(b) contacting said molecular sieve with an aqueous solution of water soluble alkali polysulfide until said molecular sieve is saturated with said aqueous solution; and (c) drying said saturated molecular sieve of (b) at a temperature of between about 10° and about 75° C. and a pressure of less than about 500 millimeters of mercury to deposit said water soluble alkali polysulfide onto said molecular sieve without decomposing the water soluble alkali polysulfide, wherein said molecular sieve is selected from the group consisting of sodium zeolite x, sodium zeolite y, zeolite beta, zeolite 20, and synthetic faujasite.

9. The product of claim 8 wherein said alkali sulfide is sodium polysulfide containing between about 5 and about 25% sulfur.

10. The product of claim 8 wherein said saturated product of (b) is dried in a two step process wherein the first step comprises drying the adsorbent at a temperature between about 10° and about 30° C. and a reduced pressure and subsequently drying the resulting product at a temperature between about 30° and about 75° C. under a reduced pressure of 1 millimeter.

11. The product of claim 8 wherein the concentration of sulfur in the alkali polysulfide is between about 5 and about 25% by weight.

* * * * *